US005630745A

United States Patent [19]

Yeh

[11] Patent Number: 5,630,745

[45] Date of Patent: May 20, 1997

[54] FIGURE HAVING NUMEROUS SEAMLESS REPOSITIONABLE PARTS

[76] Inventor: Hsu-Chong Yeh, 24 Jefferson Ave., Tenafly, N.J. 07670

[21] Appl. No.: 565,629

[22] Filed: Nov. 27, 1995

Related U.S. Application Data

[63] Continuation of Ser. No. 110,966, Aug. 24, 1993, abandoned.

[51] Int. Cl.[6] ..... A63H 3/04

[52] U.S. Cl. ..... 446/374; 446/385; 446/390

[58] Field of Search ..... 446/374, 373, 446/375, 370, 385, 390, 376–383

[56] References Cited

U.S. PATENT DOCUMENTS

| | | | |
|---|---|---|---|
| 1,259,782 | 3/1918 | Savage | 446/374 |
| 3,009,284 | 11/1961 | Ryan | 446/268 X |
| 3,284,947 | 11/1966 | Dahl | 446/374 |
| 3,395,484 | 8/1968 | Smith | 446/374 |
| 3,634,966 | 1/1972 | Ostrander . | |
| 3,862,513 | 1/1975 | Isaacson . | |
| 3,921,332 | 11/1975 | Terzian et al. . | |
| 4,123,872 | 11/1978 | Silva | 446/374 |
| 4,295,291 | 10/1981 | Fukui . | |
| 5,083,966 | 1/1992 | Blank . | |

FOREIGN PATENT DOCUMENTS

| | | | |
|---|---|---|---|
| 632811 | 1/1928 | France | 446/374 |
| 1060435 | 4/1954 | France | 446/374 |

*Primary Examiner*—Mickey Yu
*Attorney, Agent, or Firm*—Jordan and Hamburg

[57] ABSTRACT

A figure configured in the shape of human or animal with multiple repositionable parts is disclosed. The figure is made of two kinds of soft resilient materials, one is of extra softness to be placed in the joint areas; the other is of average softness to be placed in all other areas. Coated on the surface of the figure is rubber or rubber-like resilient material which can be textured and colored. Running through the torso and various parts of the figure are single or multiple internal flexible wires or braided wires. Rigid bars are bonded to the internal flexible wires or braided wires in the nonflexible parts. By protruding rigid bars into a joint from both proximal and distal aspects of joint, and not bonding protruded parts of rigid bars to the internal flexible wires, one can restrict direction and range of the bendability of the joint. A coil encases the internal flexible wires or braided wires within the repositionable joints to extend the life of the internal flexible wires or braided wires.

7 Claims, 1 Drawing Sheet

FIGURE HAVING NUMEROUS SEAMLESS REPOSITIONABLE PARTS

This application is a continuation of application Ser. No. 08/110,966, filed Aug. 24, 1993, now abandoned.

BACKGROUND OF THE INVENTION

Figures of dolls which are capable of assuming various poses are very popular, especially if all parts which are supposed to be respositionable can be repositioned into desired poses with ease and without any external support. Many devices have been developed in the past, but none has achieved a satisfactory result. Such devices include: a poseable soft doll which needs external support and has only a very limited range of poseability (U.S. Pat. No. 5,083,966); a spring biased arm for a repositionable arm (U.S. Pat. No. 3,862,513); using elastic joiner or resilient mean combined with various devices e.g., a hook and socket (U.S. Pat. No. 3,634,966); using elastic joiner connecting two parts through one or a group of slots (U.S. Pat. No. 4,295,291); using resilient means to hold a ball and socket as well as an intermediate joint member together to form an articulated joint (U.S Pat. No. 3,921,332) etc. In all devices which have been invented in the past, there is either a limited number of repositionable parts, a limited range of repositionability or unsightly or unnatural looking surfaces at the repositionable joints due to a cleft or clefts at the joints.

SUMMARY OF THE INVENTION

The present invention is directed at providing various new joint structures which derive from one basic principle, i.e., a repositionable internal flexible bar or core (e.g., braided wire) encased in an extra soft, pliable and resilient material to form the joints. The joints can be applied to various parts of a figure. The joint structures vary depending on the size and range of motion of each individual joint. All parts of the figure can be made repositionable as desired and the range of motion of each joint can be equal to or surpass those in real life depending on the material used.

The present invention comprises soft resilient material (such as foam) which forms the shape of a figure. The surface of the figure is coated with a resilient material (such as rubber) which can be textured and colored. Adding geso to casting rubber not only provides a white base for coloring but also tempers the rubber so that the rubber will not be too resilient, i.e., when a joint of the figure is bent, it will stay bent and not rebound. Running through the torso and all parts of the figure are single or multiple internal flexible bars made of material (e.g., wire or braided wire) which is relatively strong but relatively easy to bend, twist or straighten and remains bended, twisted or straight and does not rebound after the external force is released. In the nonflexible parts of the figure, e.g., head, chest, upper arm, forearm, thigh, lower leg etc., the internal flexible bar is made nonflexible by bonding to it a segment of rigid bar. For larger joints, e.g. neck, shoulder, hip, elbow, knee and waist, an extra soft, pliable and resilient material (e.g., foam with large bubbles) fills the joint area, replacing the soft resilient material in order to facilitate the bending, twisting or straightening actions. Using two kinds of resilient material to manufacture the figure is very important because if one uses only the resilient material of average softness, not only relatively large-sized joints will be difficult to bend, the joints will look very unnatural when they are bent. On the other hand, if one uses only a resilient material of extra softness to manufacture the figure, not only will the figure be too soft and not feel like flesh, the joints will appear deformed or collapsed when they are bent. The rigid bar is added to the back side of the internal flexible bar in the upper arm and protrudes into the elbow joint. The protruded part is not bonded to the internal flexible bar. The rigid bar is also added to the back side of the internal flexible bar of the forearm and protrudes upward into the elbow joint. The protruded part is not bonded to the adjacent internal flexible bar. This construction will allow the elbow joint to bend only forward but not backward because during backward bending the protruded parts of said rigid bars from both upper arm and forearm will meet in the elbow joint. This will lock the elbow joint in straight position and prevent backward bending. For the knee joint, the configuration of construction is the opposite to that of the elbow joint so that the knee can be bent only backward but not forward.

For a joint of small diameter, such as may be found in a finger or toe, the extra soft, pliable and resilient material may not be necessary. When a part is small in diameter, one may do without the soft resilient material which is used to fill the other parts of the figure. The entire small part may simply be constructed with the internal flexible bar and the resilient material which is used for coating the surface of the figure to make the construction easier.

The present invention allows one to construct a figure with any part to be as repositionable as one likes it to be. Adding rigid bar to the nonflexible parts will facilitate repositioning. The range and direction of repositionability of a joint can be made to its full extent or as restricted as one likes it to be. Furthermore, the entire figure is relatively soft but with internal rigid core or bar similar to skeleton. This, in addition to numerous repositionable parts, makes it more like a real life figure than any other toy or figure. The whole figure is in a perfect unity without any unsightly slot, cleft, disruption or deformity at the joints and the surface of the entire figure is covered with a resilient surface which can be textured or colored in any manner. Therefore, the present invention allows construction of a very attractive, beautiful or useful figure of any kind: a humanoid figure or toy, manikin or mannequin, animal or the like. The figure can be used as a toy or as a model for art work, fashion designing or animation. One can also use it as a basic re-usable artistic figure to reposition into different poses. Each repositioned pose can be cast into a different piece of sculpture art work.

In the foregoing general description, the objects, features and advantages of the present invention have been set out. The present invention may be best understood by reference to the following description, taken in connection with the accompanying drawings.

DETAILED DESCRIPTION OF THE INVENTION

Figure 1:
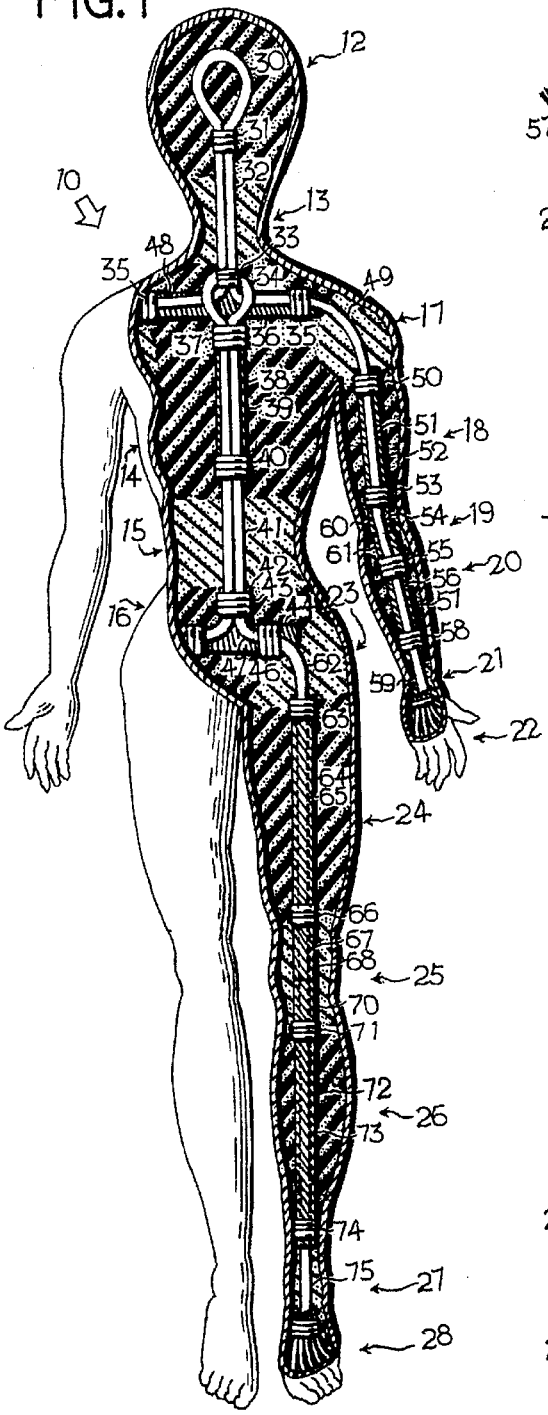
FIG. 1 is a front view of a specific embodiment of a humanoid figure of the present invention in an erect position, and partially in section to facilitate the illustration of the internal structures of the figure.

Referring to FIG. 1, a preferred embodiment of the present invention, a humanoid figure which is generally designated 10, is illustrated. The figure has a head portion 12, a neck 13, an upper torso portion 14, a waist 15, a lower torso portion 16, a pair of shoulders 17, a pair of upper arms 18, a pair of elbow joints 19, a pair of forearms 20, a pair of wrist joints 21, a pair of hands 22, a pair of hip joints 23, a pair of thighs 24, a pair of knee joints 25, a pair of lower legs 26, a pair of ankle joints 27, and a pair of feet 28.

The entire figure comprises soft resilient material (e.g., foam) (shown here as heavy lines with dots) except within the repositionable joint areas, i.e., neck 13, waist 15, shoulder 17, elbow 19, wrist 21, hip 23, knee 25 and ankle 27 where an extra soft, pliable and resilient material (e.g. foam with relatively large bubbles) (shown here as thin lines with dots) fills in the areas. The surface of the entire figure is coated with a resilient material (e.g. rubber) and, therefore, the surface of the entire figure is continuous without a break or disruption. The surface of the figure can be textured and colored.

A braided wire (simplified as a white bar in FIGS. 1 to 7) is folded in half and is made into a loop 30 at the folded part. The loop 30 of braided wire is placed in the center of the head 12. The two segments 32 of the braided wire extend down from the loop 30 and pass down through the neck 13 into the upper chest. The two segments 32 of braided wire are tied or bonded together between two points 31 and 33. Below point 33 in the upper chest, the two braided wires 38 are bent sideways, one to each side 48 and each goes into one shoulder 49, then bends down into the upper arm 51 and continues into the elbow 54, forearm 56, wrist 59 and finally into the palm 87 (see FIG. 6).

Another braided wire is also folded in half and a loop 34 is made at the folded part. Within the upper chest, the new loop 34 of the braided wire encircles the lower end 33 of the two segments of braided wire which pass down from the head into the upper chest region. Two segments 38 of the braided wire extend down from the loop 34 of braided wire and pass through the chest and waist 41 down into the lower torso portion where the two braided wires 38 are bent sideways, one to each side 47 and each goes into a hip 62, then continues into a thigh 65, and continues into a knee 67, lower leg 73, ankle 75 and finally into a foot 101 (see FIG. 7).

A T-shape rigid bar 36 and 39 which is made of rigid material (wood, plastic, metal, etc.) is tied (or bonded with some other means) to the horizontal 48 and double vertical 38 braided wires in the chest between two points 35 on both sides for the horizontal portion and between two points 37 and 40 for the vertical portion.

Within the lower torso portion 16, a reverse T-shape (with a short vertical bar) rigid bar 42 and 44 is tied (or bonded) between 43 and 46 (on both sides) to the double vertical 41 and horizontal 47 braided wires in the lower torso position.

Within the upper arm 18, a straight rigid bar 52 is placed behind the braided wire 51 and extends a portion 60 midway down into the elbow joint 19 and tied (or bonded) between 50 and 53 to the braided wire 51 but leaving the portion 60 protruding within the elbow joint unbonded to the braided wire 54. With the elbow joint 19 in straight position, another straight rigid bar 57 is placed behind the braided wire 56 within the forearm 20. The straight rigid bar 57 extends a portion 61 upward into the elbow joint 19 to meet the other straight rigid bar portion 60 which extends down from upper arm. The straight rigid bar 57 is tied (or bonded) (between 55 and 58) to the braided wire 56 but has the protruded portion 61 in the elbow joint 19 unbonded to the braided wire 54.

Figure 2:
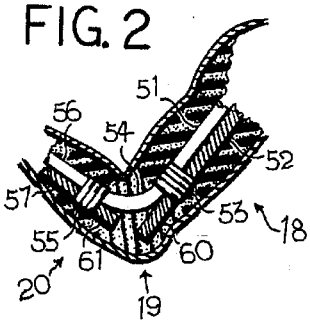
FIG. 2 is an elevational view of a cross section of a left elbow joint in a flexed position.
Figure 3:
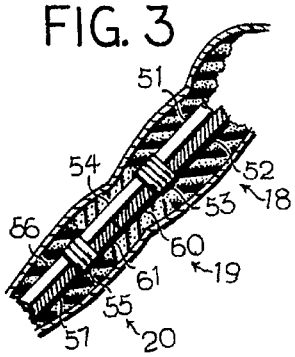
FIG. 3 is an elevational view of a cross section of the elbow joint of FIG. 2 in a straight position.

Referring to FIGS. 2 and 3, the elbow joint 19 operation is shown. FIG. 2 shows the two protruding straight rigid bar portions, one 60 from the upper arm and the other 61 from the forearm, not tied or bonded to the braided wire 54. Therefore, the braided wire 54 can be bent, i.e., the elbow joint 19 can be bent without restriction. But when the elbow 19 is straightened, as shown in FIG. 3, the two protruding straight rigid bars 60 and 61 will meet each other. This meeting causes the elbow joint 19 to lock in a straight position and, therefore, backward bending becomes impossible.

Figure 4:
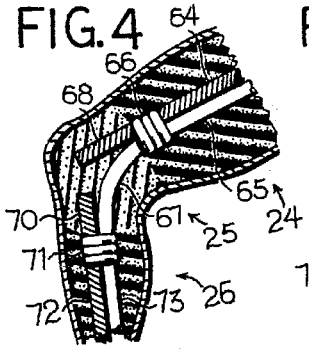
FIG. 4 is an elevational view of a cross section of a left knee joint in a flexed position.
Figure 5:
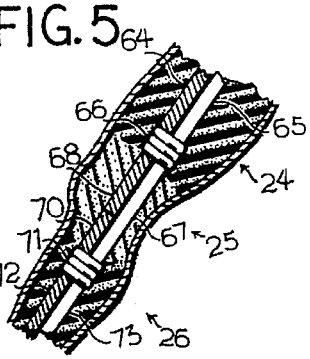
FIG. 5 is an elevational view of a cross section of the knee joint of FIG. 4 in a straight position.

Referring to FIGS. 4 and 5, another straight rigid bar 64 is placed in front of the braided wire 65 in the thigh 24 and extends a portion 68 slightly beyond midway into the knee joint 25 (i.e. to the lower edge of the knee cap). The straight rigid bar 64 is tied (or bonded) to the braided wire 65 in the thigh between 63 and 66 but has the protruding portion 68 within the knee joint 25 unbonded to the braided wire 67. With the knee joint 25 in the straight position, another straight rigid bar 72 is placed in front of the braided wire 73 in the lower leg 26 and a portion 70 extends to meet the other protruding straight rigid bar portion 68 which extends down from the thigh. The straight rigid bar 72 is tied (or bonded) between 71 and 74 to the braided wire 73 in the lower leg while leaving the protruded portion 70 within the knee joint unbonded to the braided wire 67 behind.

FIGS. 4 and 5 show how the knee joint 25 works in an opposite way compared to the elbow joint 19. When the knee 25 is bent backward as shown in FIG. 4, the two protruding straight rigid bar portions 68 and 70 within the knee joint are separated from the braided wire 67 because they are not bonded to said braided wire 67 and thus the knee 25 can be bent backward. But when the knee 25 is straightened, as shown in FIG. 5, the two protruding straight rigid bar portions 68 and 70 meet each other. The meeting locks the knee joint 25 in the straight position so that the knee 25 cannot be bent forward.

Figure 6:
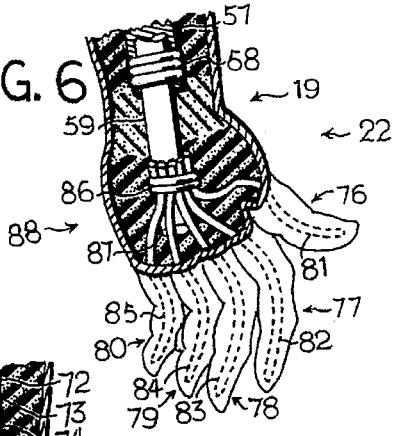
FIG. 6 is an enlarged partially cross-sectional front view of a left hand.

Referring to FIG. 6, the braided wire 59 within the wrist 21 enters the palm 88, five small braided wires 81–85 are bonded to a braided wire portion 87 in the palm 88. The small braided wires 81, 82, 83, 84 and 85 extend into thumb 76, index finger 77, middle finger 78, ring finger 79 and little finger 80 respectively.

Figure 7:
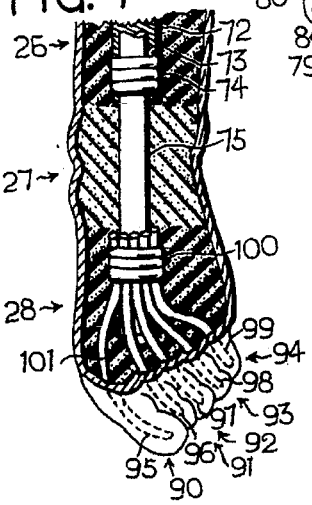
FIG. 7 is an enlarged partially cross-sectional view of a left foot.

Similarly, as shown in FIG. 7, after the braided wire 75 in the ankle enters the foot 28, five small braided wires 95–99 are bonded 100 to a braided wire portion 101. These five small braided wires 95, 96, 97, 98 and 99 extend into big 90, second 91, third 92, fourth 93 and little 94 toes respectively.

Figure 8:
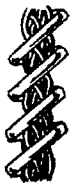
FIG. 8 is a braided wire encased in a coil which can be used in any joint in order to extend the life of said braided wire. A loose coil is shown here for the purpose of a clear illustration.

Referring to FIG. 8, a braided wire 110 encased in a coil 112 is shown. When the braided wire 110 within a repositionable joint is encased in a coil 112, the coil 112 will prevent the braided wire 110 from bending at a sharp angle. Therefore, the braided wire 110 is less likely to break after numerous bending and straightening actions, i.e., thus the life of the braided wire 110 is extended.

The foregoing detailed description for a preferred embodiment of the present invention has been given for the purpose of clearness of understanding only. Modifications and variations will become apparent to those skilled in the art. Such modifications and variations are considered to be within the purview of the following claims.

I claim:

1. A doll figure comprising:

a skeleton-simulating flexible framework having substantially rigid portions and bendable portions representing joints;

body simulating means for simulating soft tissue enclosing said skeleton-simulating flexible framework and forming an exterior of said doll figure;

said skeleton-simulating flexible framework being made of material manually bendable and torsionally deformable and permanently deformable by manual force at said bendable portions;

said body simulating means including at least first and second resilient materials wherein said second resilient material is softer than said first resilient material;

said second resilient material being disposed around said skeleton-simulating flexible framework at at least one of said bendable portions to facilitate life-like deformation at said at least one of said bendable portions during flexing of the bendable portion simulating bending at one of said joints; and said first resilient material being disposed around said skeleton-simulating flexible framework at at least a portion of said substantially rigid portions to simulate body tissue at areas other than said joints.

2. The doll of claim 1 wherein the skeleton-simulating flexible framework is made of one of multiple and braided wires.

3. The doll of claim 1 wherein said substantially rigid portions are made of rigid material bond to a flexible deformable material.

4. The doll of claim 1 wherein the body simulating means is coated with resilient skin material selected from the group consisting of rubber and casting rubber.

5. The doll of claim 1 wherein:

the substantially rigid portions extend into and terminate in at least one of the bendable portions to allow said one of the bendable portions to bend in one direction and prevent said one of the bendable portions from bending in another direction;

said substantially rigid portions being unbonded to said skeleton-simulating flexible framework within an area representing one of said joints; and the degree of restriction of bending action depending on lengths of said substantially rigid portions extending into said at least one of the bendable portions which determine an orientation of said substantially rigid portions relative to each other at a position where said substantially rigid portions abut one another.

6. The doll of claim 2 wherein at least a portion of the braided wires is encased in coil.

7. The doll of claim 4 wherein gesso and water color are mixed with the resilient skin material.

* * * * *